US005546723A

United States Patent [19]

Jones

[11] Patent Number: 5,546,723

[45] Date of Patent: Aug. 20, 1996

[54] WOOD SILL REINFORCEMENT PLATE

[75] Inventor: Robert G. Jones, Arcadia, Calif.

[73] Assignee: Harlen Metal Products, Inc., Compton, Calif.

[21] Appl. No.: 169,227

[22] Filed: Dec. 20, 1993

[51] Int. Cl.[6] ..... F04B 1/38

[52] U.S. Cl. ..... 52/698; 52/704; 52/410; 411/466; 411/163

[58] Field of Search ..... 52/295, 292, 410, 52/411, 413, 698, 704, 489, 293.3; 411/461, 466, 161, 163, 107, 457

[56] References Cited

U.S. PATENT DOCUMENTS

| | | | |
|---|---|---|---|
| 277,076 | 5/1883 | Stuart | 411/163 |
| 1,791,337 | 2/1931 | Wendell | 411/466 |
| 2,895,369 | 7/1959 | Andersen | 411/466 |
| 3,212,819 | 10/1965 | Churchill | 411/466 |
| 3,270,610 | 9/1966 | Knowlton | 138/96 R |
| 3,449,997 | 8/1967 | Couch | 411/466 |
| 4,531,861 | 7/1985 | Kash | 52/704 |
| 4,543,763 | 10/1985 | Ernst et al. | 52/698 |
| 4,787,188 | 11/1988 | Murphy | 52/410 |
| 5,063,722 | 11/1991 | Hohmann | 411/457 |
| 5,315,800 | 5/1994 | Weber et al. | 52/698 |

*Primary Examiner*—Carl D. Friedman
*Assistant Examiner*—Winnie Yip
*Attorney, Agent, or Firm*—Charles H. Schwartz; Ellsworth R. Roston

[57] ABSTRACT

A wood sill reinforcing plate for use with anchor bolts embedded in a concrete foundation and extending upward and a wood sill having openings which receive the outwardly extending anchor bolts. A plate member having an opening extending through the plate member and with the opening having a dimension slightly larger than the diameter of the anchor bolt. A plurality of gripper prongs integral with the plate member and extending in a direction substantially perpendicular to the plate member for embedding the gripper prongs into the wood sill to lock the plate member around the anchor bolt with the anchor bolt extending through the opening in the plate member.

6 Claims, 2 Drawing Sheets

WOOD SILL REINFORCEMENT PLATE

BACKGROUND OF THE INVENTION

In new residential construction, most houses are built on a concrete slab foundation or on foundation walls. Typically, anchor or foundation bolts are placed in the wet concrete a minimum of six feet on center around at least the perimeter of the house. A wood sill is then used in conjunction with the anchor bolts to tie the house to the foundation by having the anchor bolts pass through corresponding openings through the wood sill.

In order to mark the location of the anchor bolts on the wood sill, the framer normally lays the wood sill on top of the bolts and hits the wood with the hammer to leave an imprint in the wood at the position of the anchor bolts. The framer will then drill the holes, build the wall section and hoist it over the bolts flush with the concrete. In accordance with model building codes, the holes should be no more than 1/16 of an inch larger than the bolts. In practice, framers often drill oversized holes so that it is easier to locate the wall on the bolts and then slam it down flush to the concrete. Then the framer puts a washer and a nut over the bolt and tightens them down to secure the wood sill, thereby securing the wall section to the foundation.

In an earthquake, the bolt to wood sill connection is supposed to restrain the house from shifting off the foundation. However, ground movement causes the anchor bolt to transfer the load to one edge of the hole thereby crushing the wood which could ultimately cause the wood to split. In addition, if the hole is oversized, the house may shift as much as ¼" before the bolt begins to restrain movement but the house has already built up substantial momentum before it meets with the resisting side of the hole. Therefore, considerable damage can occur above and below the floor line even at very low quake levels. As a specific example, in a recent earthquake in the Big Bear area of California, there were a number of failures in newly constructed homes with oversized holes around the anchor bolts. Some of these homes slipped completely off their foundations and were a total loss.

SUMMARY OF THE INVENTION

The present invention provides for a wood sill reinforcement plate including a flat plate section having an opening just slightly larger than the diameter of the anchor bolt and a plurality of prong members which extend outward from the flat plate. The use of the present invention ensures that damage, and possible failure of a building structure, can be reduced by using the wood sill reinforcement plate to transfer the force from the anchor bolt through the reinforcement plate to the gripper prongs and down into the wood.

The wood sill reinforcement plate of the present invention may be used in a number of ways. First, the reinforcement plate can be placed on top of the wood sill around the anchor bolt to merely replace the washer that is normally used. This would be the least expensive way of using the present invention but it still allows the anchor bolt to bend through the opening in the wood sill before restraint by the reinforcement plate of the present invention.

A second way of using the reinforcement plate of the present invention is to place the reinforcement plate over the anchor bolt prong side up before the wall section is placed over the anchor bolts. The weight of the wall section will drive the prongs into the wood sill. A normal washer and nut would still be used at the top surface of the wood sill but the use of the reinforcement plate at the bottom position immediately transfers the load to restrain movement.

The best and most preferred use of the present invention is to place reinforcement plates on both the top and bottom positions of the wood sill surrounding the anchor bolt. This tightly restrains the anchor bolt and optimizes the load transfer from the house down to the foundation. Extensive developmental testing was performed on this device. In addition, eight series of three tests each were conducted according to the standards of the International Conference of Building Officials, the model code enforcement agency of the Uniform Building Code (used by all Western States). Anchor bolts were tested without the device and with the device on the top, the bottom, and on top and bottom. Both appropriately sized holes (1/32" larger than the bolt), and oversized holes (¼" larger than the bolt) were tested.

Using the reinforcement plate of the present invention improved the ultimate bolt-to-wood connection by 15% when used on top, by 30 to 38% when used on the bottom and by 81–88% when used on the top and bottom. This suggests that the reinforcement plate is a powerful tool for reducing the ultimate failure of the sill plates.

An even more important finding was that there was a 150% to 300% improvement of the bolt-to-wood connection at low forces when the hole was oversized. This suggests that even in a minor quake, considerable cosmetic and some structural damage can be reduced by using the reinforcement plate.

DETAILED DESCRIPTION OF THE PREFERRED EMBODIMENTS

Figure 1C:
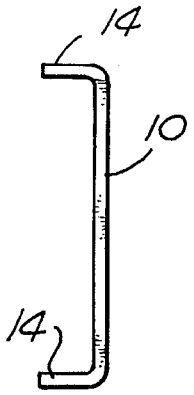
FIGS. 1(*a*), 1(*b*) and 1(*c*) illustrate a top and two side views of a first and preferred embodiment of the present invention, FIGS. 2(*a*), 2(*b*) and 2(*c*) illustrates a top and two side views of the second embodiment of the invention, FIGS. 3(*a*), 3(*b*) and 3(*c*) illustrates a top and two side views of a third embodiment of the invention, FIGS. 4(*a*), 4(*b*) and 4(*c*) illustrates a top and two side views of a fourth embodiment of the invention.
Figure 1A:
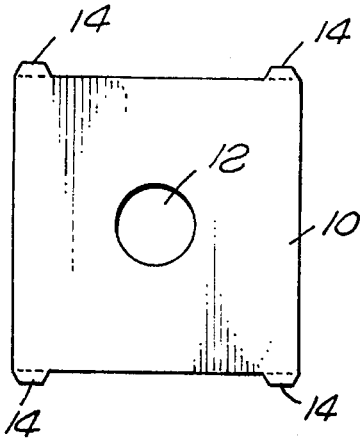
Figure 1B:
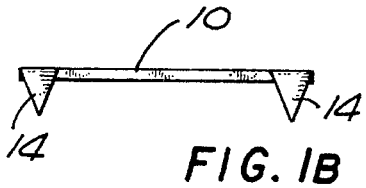

As shown in FIGS. 1(*a*), 1(*b*) and 1(*c*), a wood sill reinforcement plate includes a flat plate section 10 with an opening 12 extending through the plate 10 and having a diameter slightly larger than an anchor bolt to receive an anchor bolt. In addition, a plurality of gripper prongs 14 extend downward and are shown to be formed with a sharp point so as to pass into and grip the wood sill when the reinforcing plate of the present invention is installed in the construction of homes.

Figure 2C:
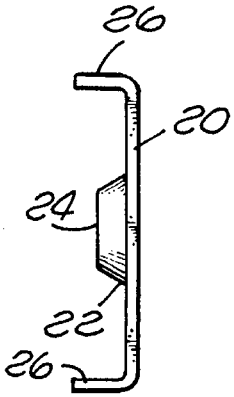
Figure 2A:
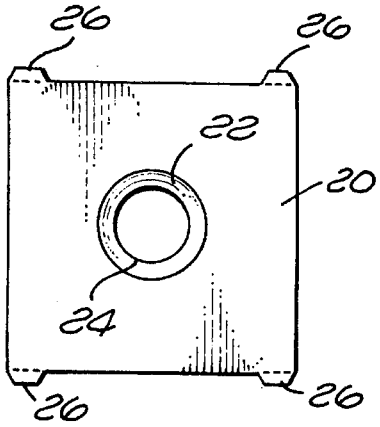
Figure 2B:
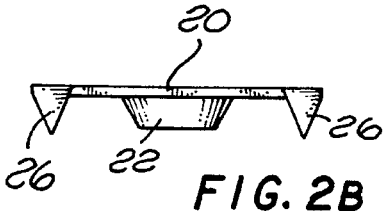

In FIGS. 2(*a*), 2(*b*) and 2(*c*) illustrate a second embodiment and has a flat plate portion 20 includes an opening 22. As can be seen, the opening 22 is actually formed with a tapered portion extending downward to have a lower portion 24 of approximately a size to receive the anchor bolt. The tapered portion forms a gripper surface to extend into any open area between the anchor bolt and the opening in the wood sill to fill the opening and to strengthen the corner providing additional reinforcement for the wood. The embodiment of FIG. 2 also includes gripper prongs 26 similar to the prongs 14 in FIG. 1.

Figure 3C:
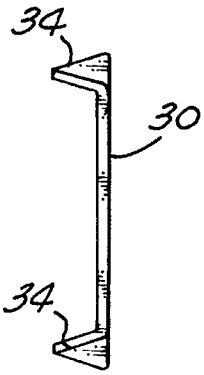
Figure 3A:
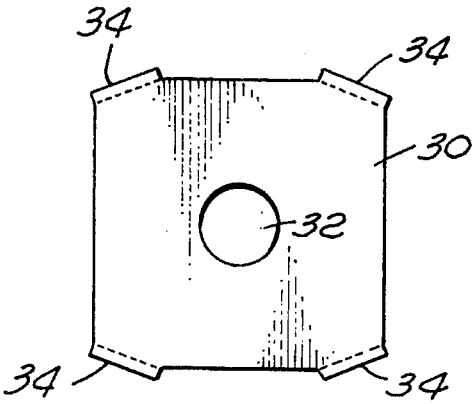
Figure 3B:
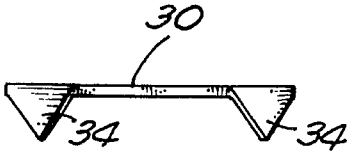

FIGS. 3(*a*), 3(*b*) and 3(*c*) show yet another embodiment of the present invention including a plate portion 30 with an opening 32 to receive the anchor bolt. The plate 30 has slightly canted corners so that gripper prongs 34 have a slightly wider profile then the gripper prongs 14 and 26 of FIGS. 1 and 2 respectively. The gripper prongs 34 would thereby enter the wood at a slight angle across the grain increasing the drag through the wood and reducing the parallel tracking through the wood as occurs with the gripper prongs of FIGS. 1 and 2.

Figure 4C:
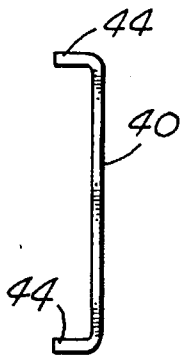
Figure 4A:
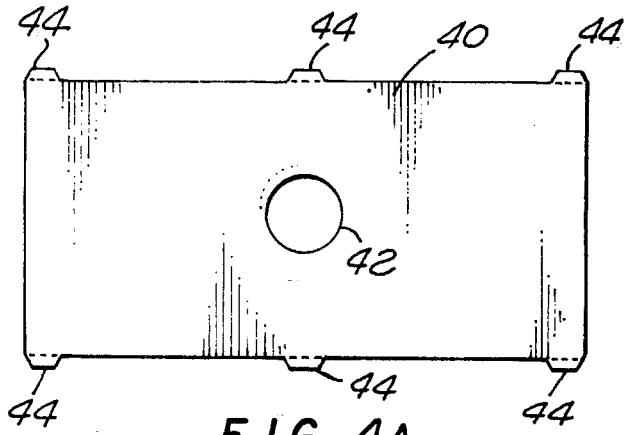
Figure 4C:
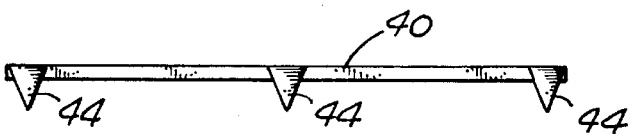

Finally, FIG. 4(*a*), 4(*b*) and 4(*c*) illustrate a fourth embodiment of the invention which is essentially similar to the embodiment shown in FIG. 1 except that a plate member 40 has an elongated rectangular form. The plate 40 includes an opening 42 to receive the anchor bolt. A plurality of gripper prongs 44, which are six in number, extend downward and grip the wood in a similar manner to those shown in the embodiments of FIGS. 1, 2 and 3. Theoretically, the larger number of gripper prongs will spread the load even further into the wood sill in the event of an earthquake.

Figure 5:
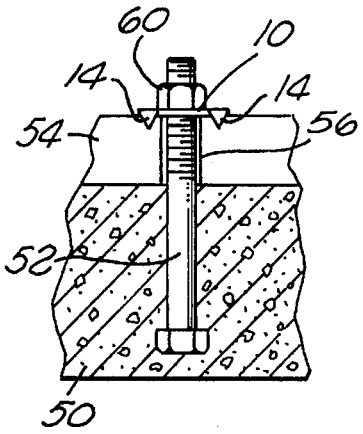
FIG. 5 illustrates the invention used only on the top of the wood sill.
Figure 6:
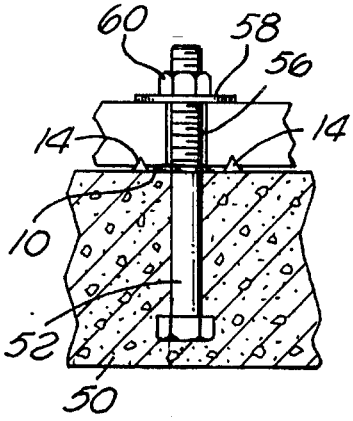
FIG. 6 illustrates the invention used only on the bottom of the wood sill.
Figure 7:
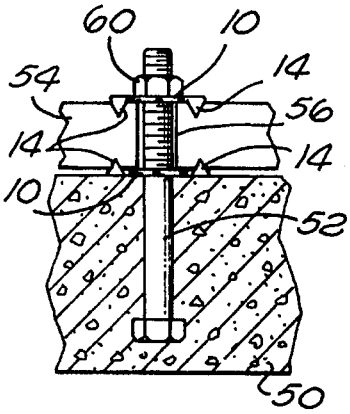
FIG. 7 illustrates the invention used both top and bottom of the wood sill.

FIGS. 5, 6 and 7 illustrate the use of the wood sill reinforcement plate of the present invention and specifically illustrate this use with the embodiment of FIG. 1. The embodiment of FIG. 1 is the simplest in construction and the most inexpensive to manufacture, but depending upon specific applications, other embodiments such as shown in FIGS. 2, 3 and 4, may be desired for other applications. In normal practice, the embodiment of FIG. 1 is sufficient for most uses.

As shown in FIGS. 5, 6 and 7 a concrete foundation 50 extends under a house and with anchor bolts 52 set into the concrete approximately every six feet around the perimeter of the house in order to tie the house to the foundation through a wood sill 54. This is normal and typical construction for homes and the anchor bolts are normally placed in the concrete while wet for new construction but may be retrofit into existing homes using conventional techniques.

In order to mark the location in which to drill holes 56 through the wood sill 54, the framer normally lays the wood sill on top of the bolts 52 and bangs the wood plate 54 with a hammer so as to make an impression in the wood. The framer drills the holes 56 and then pushes the wood sill over the anchor bolts down onto the concrete foundation 50. As indicated above, the holes 56 should only be slightly larger, such as 1/16 inch larger than the bolts. In practice, the framers can drill oversized holes 56 so that it is easier to push the wood sill 54 through the bolts 52 and down to the foundation 50. In normal practice, a washer and nut such as shown by the washer 58 and nut 60 are used to lock the anchor bolt 52 to the wood sill 54. In the present invention, the nut 60 would still be used, but the washer 58 may be replaced with the reinforcing plate of the present invention.

As shown in FIG. 5, a single reinforcing plate 10 is used for each anchor bolt 52 and located only on the one upper side of the wood sill 54 to replace the washer 58. As can be seen in FIG. 5, the reinforcing plate 10 would be placed around the anchor bolt 52 and the gripper prongs 14 hammered into the wood normally with the prongs extending along in the same direction as the grain of the wood. The nut 60 is then tightened down on the bolt to lock the entire structure together.

It is to be appreciated that the use of the invention, as shown in FIG. 5, can enhance existing foundation bolting systems and retrofit installations. For example, if a home already has anchor bolts with nuts and washers, the washers can be removed and replaced with reinforcing plates as shown in FIG. 5. Or, the washer can be reinstalled over the plate rather than thrown away.

In FIG. 6 the reinforcing plate 10 may be positioned directly on the concrete and with the gripper prong members extending upward. After the wood sill 54 is positioned over the anchor bolts 52, the wood sill may be hammered down to have the prongs grip the wood. The construction could be finished off using the washer 58 and nut 60 as in the prior art.

As shown in FIG. 7, the ultimate application of the present invention is to place reinforcing plates 10 both on top and bottom of the wood sill 54 surrounding the anchor bolt 52. In this way, as the bolt 60 is finally tightened into position, the reinforcing plates of the present invention tightly restrain the bolt 52 and optimize the load transfer from the house down to the foundation. As indicated above, it has been determined that the use of the invention in such a preferred manner can increase the ultimate load that the anchor bolt can carry by up to an additional 88%.

The present invention therefore provides for a reinforcing plate which is inexpensive, easy to install and inspect. The present invention increase the critical bolt to wood connection. Unlike a standard washer, the load forces are transferred to the wood sill by gripper prongs at the corners of the reinforcing plate. Standard washers need to crush down into the wood to restrain whereas the present invention does not need to crush the wood since the gripper prongs transfer the load.

It is also to be appreciated that since the present invention provides for a better anchor bolt to wood connection, this means that the bolts may be spaced further apart if desired. This provides for an additional saving in the cost of labor to install all of the bolts. Another advantage of the present invention is that the invention improves all bolt to wood connections parallel to the grain of the wood. This therefore also includes products used to restrain uplift which is a problem in the connection of shear walls and vertical members.

It should be noted that if the reinforcing plate of the present invention is used only on the top of the wood sill plate to the washer, the bolt can still bend through the wood sill before restraint. This is the least expensive use of the present invention and is considerably better than only using a washer. On the other hand, if the reinforcing plate is used only on the bottom of the wooden sill, this at least immediately transfers the load to restrain the movement. However, a washer is still required on the top. Ideally, the present invention provides the ultimate benefit by being placed both on the top and bottom of the wood sill so as to tightly restrain the anchor bolt and optimize the load transfer from the house down to the foundation.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

I claim:

1. A wood reinforcing plate that resists forces parallel to the plate in buildings of the type including anchor bolts embedded in a concrete foundation and with the anchor bolts extending upward and with a wood sill resting on the concrete foundation and with the wood sill having openings which receive the upwardly extending anchor bolts, including a plate member, means for sliding the plate member over the anchor bolt to position the plate member around the anchor bolt adjacent the wood sill including, an opening extending through the plate member and with the opening having a dimension slightly larger than the diameter of the anchor bolt, and the plate member including a plurality of integral gripper prongs extending in a direction substantially perpendicular to the plate member for embedding the gripper prongs into the wood sill to lock the plate member into the wood when the plate member is slid over the anchor bolt and positioned around the anchor bolt adjacent the wood sill.

2. The wood reinforcement plate of claim 1 wherein the plate member has a substantially square shape with a gripper prong at each corner.

3. The wood reinforcement plate of claim 2 wherein the gripper prongs are located on opposite sides of plate member at the corners and with the gripper prongs at each side being in line and with the gripper prongs on opposite sides being parallel to each other.

4. The wood reinforcement plate of claim 1 wherein the opening through the plate member includes a inwardly extending portion to surround the anchor bolt and fill the edge of the opening through the wood sill.

5. The wood reinforcement plate of claim 1 wherein the gripper prongs are located at corner portions of the plate member and are at an angle relative to each other at these corner portions.

6. The wood reinforcement plate of claim 1 wherein the plate member has a substantially rectangular shape and with gripper prongs located at each corner of the rectangle and with additional gripper prongs located intermediate the corner gripper prongs along sides of the rectangular plate member.

* * * * *